United States Patent [19]

Sawazaki et al.

[11] Patent Number: 4,604,877

[45] Date of Patent: Aug. 12, 1986

[54] NEEDLE SELECTION DEVICE FOR KNITTING MACHINES

[75] Inventors: Masatoshi Sawazaki; Shozo Yorisue, both of Hyogo, Japan

[73] Assignee: Precision Fukuhara Works, Ltd., Hyogo, Japan

[21] Appl. No.: 705,190

[22] Filed: Feb. 25, 1985

[30] Foreign Application Priority Data

Mar. 2, 1984 [JP] Japan ..... 59-030745[U]

[51] Int. Cl.[4] ..... D04B 9/38; D04B 15/74

[52] U.S. Cl. ..... 66/224; 66/241

[58] Field of Search ..... 66/42 R, 222, 223, 224, 66/225, 227, 241

[56] References Cited

U.S. PATENT DOCUMENTS

| | | | |
|---|---|---|---|
| 2,070,458 | 2/1937 | Steere | 66/42 R X |
| 2,473,944 | 6/1949 | Fregeolle | 66/227 X |
| 3,739,601 | 6/1973 | Plath | 66/224 X |
| 3,940,950 | 3/1976 | Sawazaki | 66/222 |

FOREIGN PATENT DOCUMENTS

| | | | |
|---|---|---|---|
| 2306884 | 4/1974 | Fed. Rep. of Germany | 66/224 |
| 1212574 | 11/1970 | United Kingdom | 66/224 |

*Primary Examiner*—Wm. Carter Reynolds

*Attorney, Agent, or Firm*—Bell, Seltzer, Park & Gibson

[57] ABSTRACT

The present unitary needle selection device is operable to selectively position the knitting needles of a circular knitting machine in either knit, tuck or welt positions. The needle selection device includes a pair of side-by-side stacks of selector slides or cams supported for individual horizontal sliding movement between innermost active and outermost inactive radial positions. The inner ends of the selector slides are aligned with selector butts of selector jacks and a pattern drum is supported for indexable rotation adjacent the outer ends of the selector slides. Pairs of vertically aligned rows of pattern combs are supported in spaced-apart relationship on the pattern drum and the pattern butts are vertically aligned and movable into engagement with the outer ends of the corresponding side-by-side stacks of selector slides.

10 Claims, 12 Drawing Figures

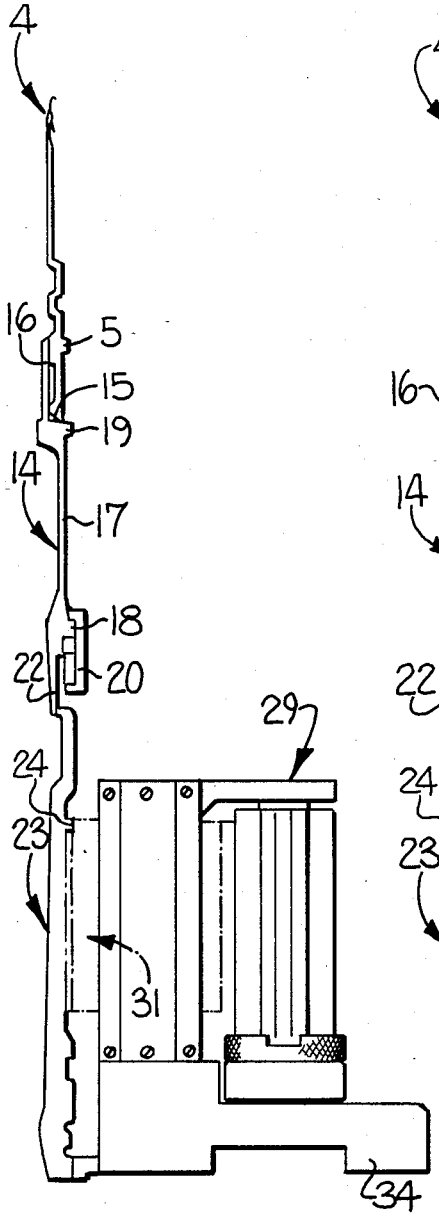
Fig-7-A
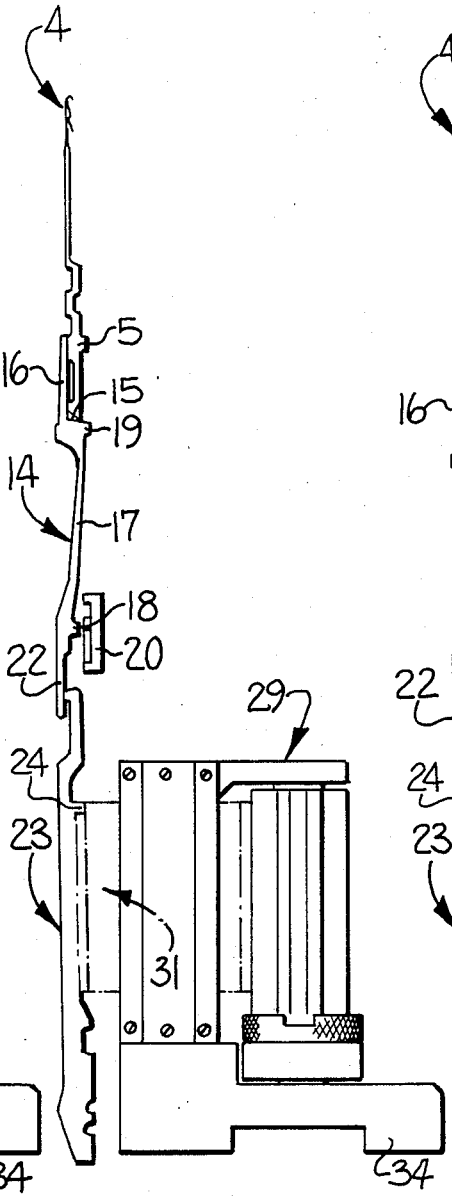
Fig-8-A
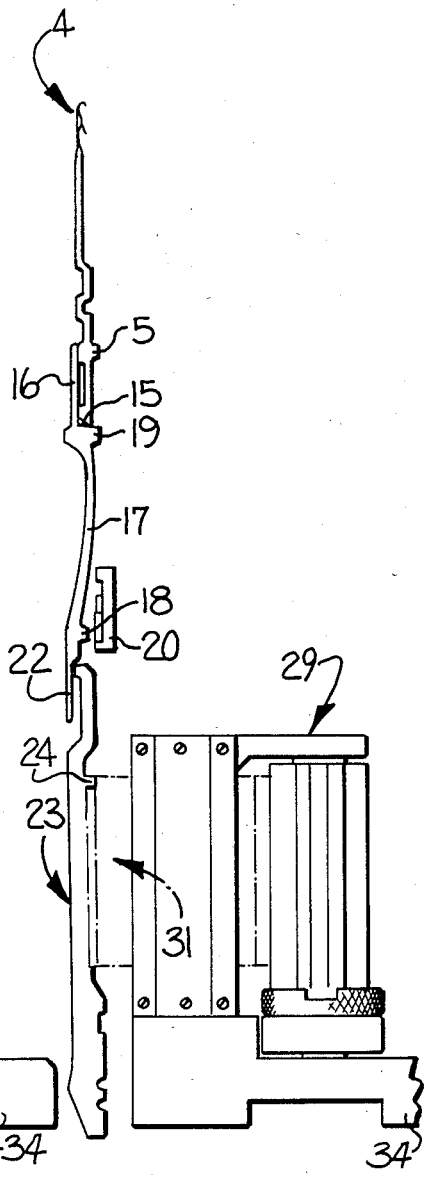
Fig-9-A
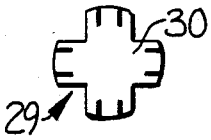
Fig-7-B
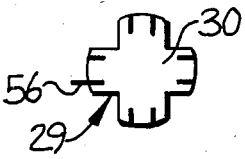
Fig-8-B
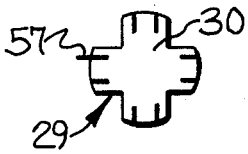
Fig-9-B

NEEDLE SELECTION DEVICE FOR KNITTING MACHINES

FIELD OF THE INVENTION

This invention relates generally to a unitary needle selection device for circular knitting machines, and more particularly to a unitary needle selection device which permits accurate and rapid selection of the needles to three positions, namely, knit, tuck, and welt positions.

BACKGROUND OF THE INVENTION

It is a well known practice to provide a flat or circular knitting machine with a jacquard pattern device for the purpose of providing various patterns in the knit fabric. There are currently several different types of needle selector means available, such as pattern wheels, selector sliders, pattern drums, combined pattern drums and selector sliders, and electronic pattern devices. The present invention relates to an improvement of the combined type of pattern drum and selector sliders.

Japanese patent publication No. 49-18503 discloses an example of the combined pattern drum and selector slider needle selection device. According to this disclosure, the needle selection device includes a pattern drum having pattern pins provided thereon. Selector sliders are adapted to be moved back and forth in horizontal direction by the pins to selectively move pattern jacks for converting the horizontal movement of the selector sliders into vertical movement of the knitting needles. However, a large diameter circular knitting machine requires a large number of pattern drums and a great amount of labor and time is required to change the pattern pins on each of the drums when the pattern of the fabric being knit is changed so that an increase in the cost of operation is involved with each pattern change. Also, the rows of selector slides are arranged in staggered relationship so that it is difficult for the operator to visualize their respective relationship to one another and errors are likely to arise when setting up a new pattern.

SUMMARY OF THE INVENTION

In contrast to the prior art pattern selection devices, it is an object of the present invention to provide a simple and practical type of unitary needle selection device which permits selective control of the knitting needles to either of three positions, namely, knit, tuck and welt positions. This object is accomplished by providing a single pattern drum with an increased number of rows of pattern butt combs supported in vertically aligned pairs and being arranged to move into aligned engagement with the outer ends of corresponding pairs of side-by-side stacks of selector slides supported for individual horizontal sliding movement between innermost active and outermost inactive radial positions.

In accordance with the present invention, the paired arrangement of pattern butt combs on the pattern drum and the paired arrangement of selector slides permits the paired selector slides to simultaneously move inwardly to operative position and also permits either one of the paired selector slides to be free from interference from the other according to the position of each of the paired pattern butt combs provided on the pattern drum. The outer ends of the paired selector slides are arranged in such a manner that one of the selector slides overlaps the other selector slide to permit simultaneous inward movement of the paired slides with engagement by a pattern butt comb with one of the selector slides.

The needle selection device of the present invention further includes a pattern jack positioned beneath each needle and the pairs of side-by-side stacks of selector slides are supported for individual horizontal sliding movement between innermost active and outermost inactive positions toward and away from the needle cylinder. The inner ends of the selector slides are vertically aligned with selector butts on the pattern jacks for selective engagement therewith and the pattern drum is supported for rotation adjacent the outer ends of the selector slides. Pairs of vertically aligned pattern butt means, in the form of the pattern butt combs, are supported in spaced-apart relationship on the peripheral surface of the pattern drum. One vertical row of each of the pairs of vertically aligned pattern butt combs is movable into aligned engagement with the outer ends of one stack of the selector slides while the other vertical row of each of the pairs of vertically aligned pattern butt combs is movable into aligned engagement with the outer ends of the other stack of selector slides. The paired arrangement of pattern butt combs and the paired arrangement of the corresponding side-by-side stacks of selector slides permits a wide variety of patterns to be knit and the patterns may be changed in a rapid and economical manner.

BRIEF DESCRIPTION OF THE DRAWINGS

Other objects and advantages will appear as the description proceeds when taken in connection with the accompanying drawings, in which

FIG. 7-A is a schematic elevational view illustrating the relationship between the needle selection device and the knitting needle when selected to move to the knit position;

FIG. 7-B is a schematic plan view of the pattern drum and illustrating the absence of butts on the paired pattern butt combs to cause selection of the knitting needles to the knit position;

FIGS. 8-A and 8-B are similar to the corresponding FIGS. 7-A and 7-B except showing the knitting needle being selected to tuck position; and FIGS. 9-A and 9-B are similar to the corresponding FIGS. 7-A, 7-B and 8-A, 8-B except showing the knitting needle being selected to welt position.

DESCRIPTION OF THE ILLUSTRATED EMBODIMENT

Figure 1:
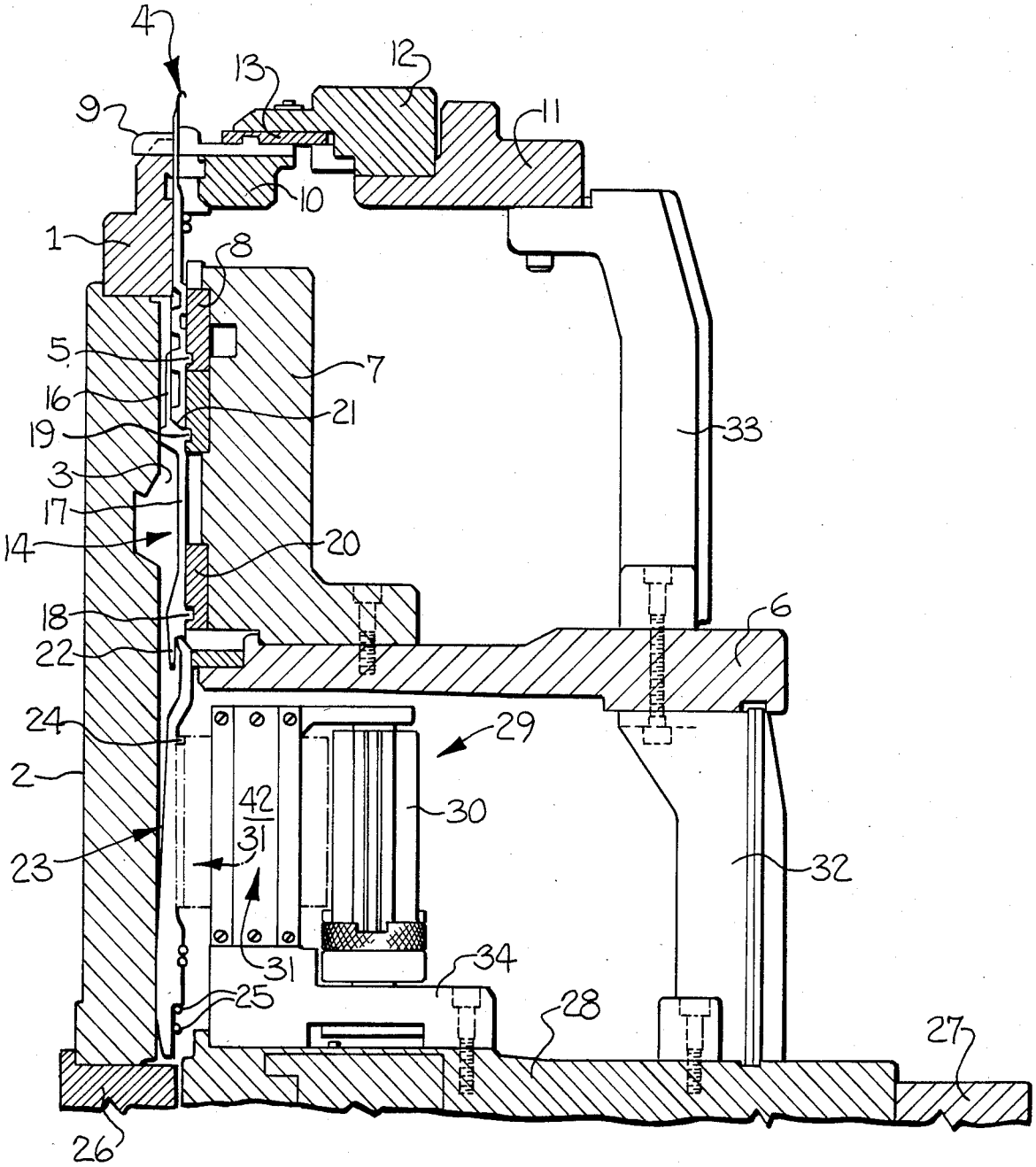
FIG. 1 is a vertical sectional view through the needle cylinder and associated parts of the knitting machine, and illustrating the present needle selection device associated therewith.
Figure 2:
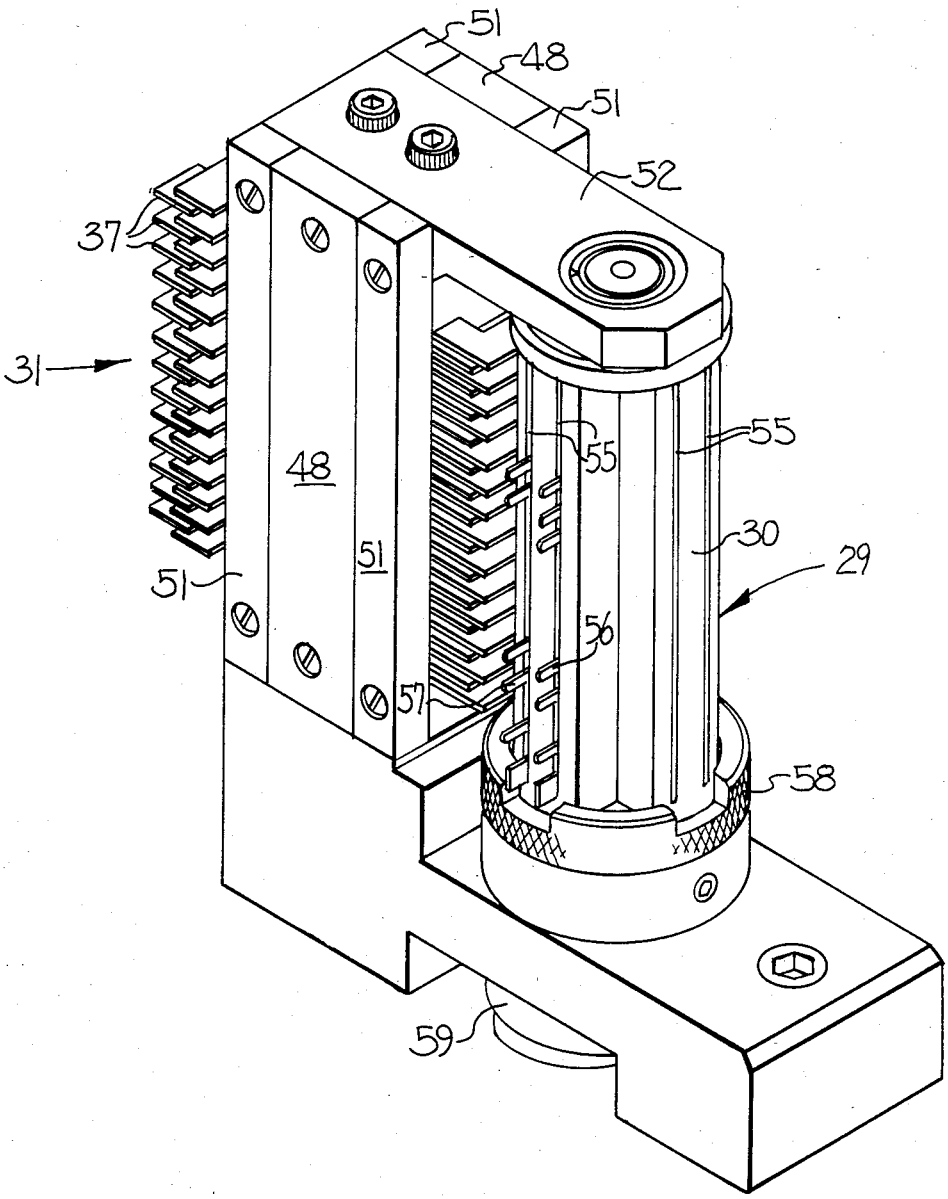
FIG. 2 is an isometric view of the needle selection device of the present invention, removed from the knitting machine.

As shown in FIG. 1, the knitting machine includes needle cylinders 1, 2 including longitudinally extending slots or grooves 3 provided therein, and knitting needles, broadly indicated at 4, are supported for vertical sliding movement in the upper portions of the needle grooves 3. Each of the knitting needles 4 is provided with an operating butt 5. A cam support bracket 7 is fixedly supported on an upper cam ring 6 and adjacent the outer peripheral surface of the needle cylinder 1, 2. A stitch cam 8 is supported on the inner face of the cam bracket 7 and controls the operation of the needle 4 by engagement with the operating butt 5. Sinkers 9 cooperate with the knitting needles 4 during the knitting operation and are supported for radial sliding movement in a horizontal direction in suitable grooves in a sinker dial 10. The sinkers 9 are controlled by sinker cams 13 carried by a sinker cap 12. The sinker cap 12 is supported in a sinker cap plate 11.

A spring jack, broadly indicated at 14, is positioned beneath each cylinder needle 4 and is provided with a shoulder 15, an upwardly extending front edge portion 16, a resilient stem portion 17, a raising butt 18, a lowering butt 19, and a lower vertical extension 22. The shoulder 15 is adapted to engage and push the corresponding cylinder needle 4 upwardly as it contacts the bottom of the cylinder needle 4. The upright front edge portion 16 constantly urges the rear edge portion of the needle 4 outwardly by means of the resiliency of the spring jack 14, in a manner to be presently described. The stem 17 is relatively slender and resilient to cause the lower end portion of the spring jack 14 to automatically return to its original straight position after the lower end portion has been forced into the innermost position. A fixed raising cam 20 is supported on the inner surface of the cam bracket 7 for engagement and disengagement by raising butt 18 and a lowering cam 21 is provided on the cam holder bracket 7 for lowering the spring jack 14 by means of the lowering butt 19.

A pattern jack, broadly indicated at 23, is disposed for rocking movement in the lower portion of the grooves 3 in the needle cylinder and beneath the spring jack 14. The lower portion of each of the patterning jacks 23 is provided with a separate level butt, indicated at 24. As mentioned, the pattern jacks 23 are supported for rocking movement in the grooves 3 of the needle cylinder and their upper ends are normally urged outwardly by annular coil springs 25. A drive gear 26 is fixed to the lower end of the needle cylinder 2 and is driven by the conventional drive mechanism of the knitting machine. A lower cam ring 28 surrounds the needle cylinder 2 and is disposed in a base plate 27. Spaced-apart support brackets 32 are fixed at their lower ends on the lower cam ring 28 and their upper ends support the upper cam ring 6. Spaced-apart upper support brackets 33 are supported at their lower ends on the upper cam ring 6 and their upper ends support the sinker cap plate 11.

Figure 5:
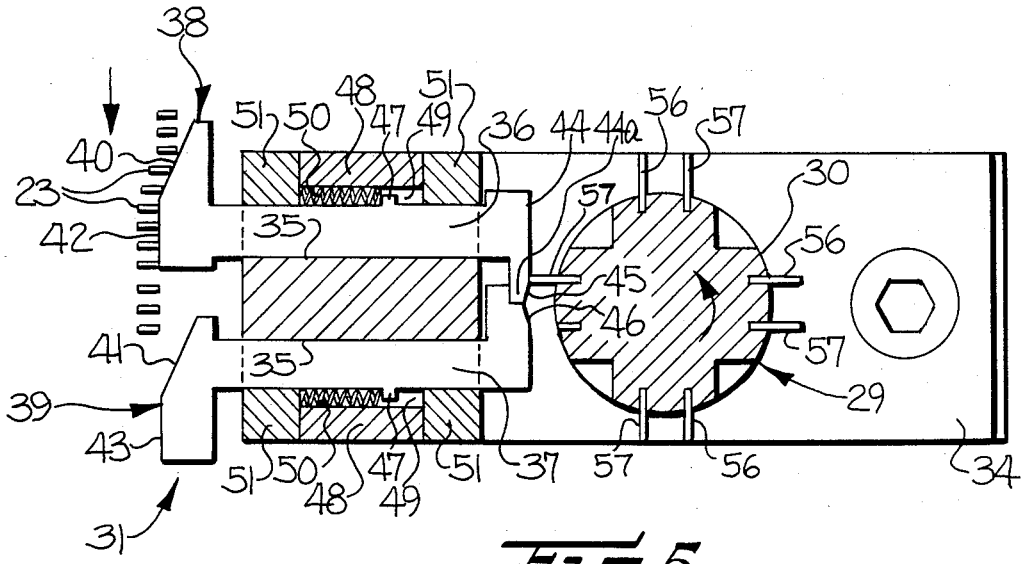
FIG. 5 is a horizontal sectional view of the needle selection device and illustrating the paired selector slides in position to cause the needles to welt.
Figure 6:
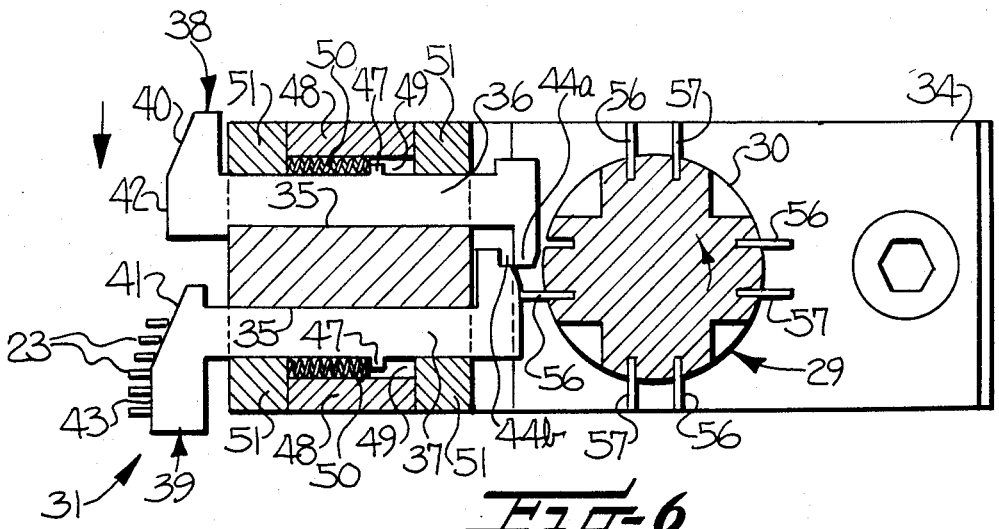
FIG. 6 is a view similar to FIG. 5 but showing the paired selector slides in position to cause the needles to tuck.

The unitary needle selection means of the present invention, broadly referred to at 29, includes a pattern drum 30 and selector slide means, broadly indicated at 31. The pattern drum 30 and the selector slide means 31 are mounted on a support bracket 34 which is fixed on the lower cam ring 28. As best shown in FIGS. 5 and 6, the selector slide means 31 includes a pair of side-by-side stacks of selector slides, referred to as welt selector slides, or first cams 36 and tuck selector slides or second cams 37, which are supported for individual horizontal sliding movement between innermost and outermost radial positions relative to the needle cylinder 2. Each stack of selector slides 36, 37 is supported for horizontal sliding movement in guide grooves 35 in the support bracket 34. The inner working head end portions, broadly indicated at 38, 39, of the corresponding welt selector slide 36 and the tuck selector slide 37 are vertically aligned with the selector butts 24 of the pattern jacks 23.

The inner working head end portions 38, 39 of the respective selector slides 36, 37 are provided with inwardly tapering sloping portions 40, 41 for forcing the pattern jacks 23 inwardly and straight cam portions 42, 43 for holding the pattern jacks in the innermost position. Engagement means, broadly indicated at 44, is provided at the rear or outer ends of the selector slides 36, 37 and is operable to automatically move the tuck selector slide 37 inwardly when the welt selector slide 36 is moved inwardly. The engagement means includes a projection **44*a* (FIG. 6) extending outwardly from one side of the selector slide 36 and a cutout 44b provided on the adjacent side of the rear end portion of the selector slide 37 and adapted to be engaged by the projection 44*a***.

Figure 4:
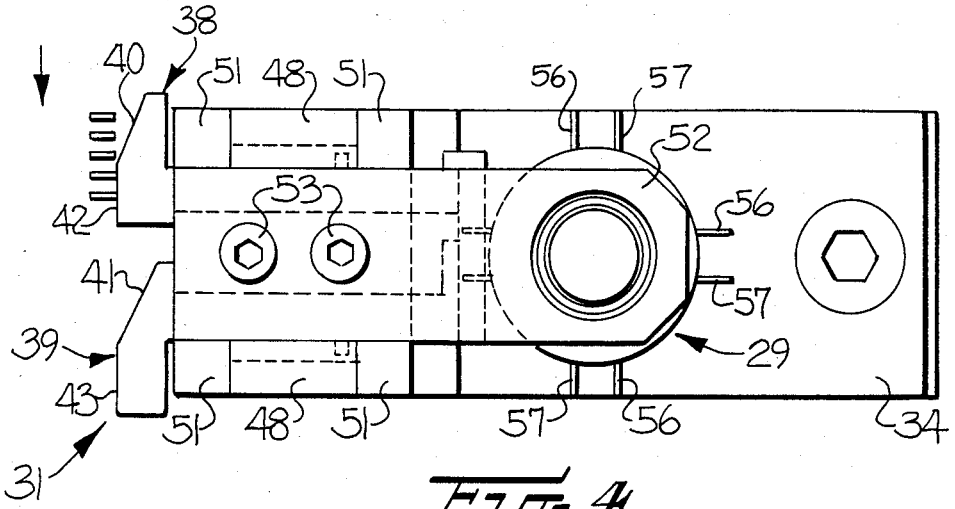
FIG. 4 is a plan view of the needle selection device of FIG. 3 and illustrating the selector slides in position to cause the needles to knit.

Projections 47 extend outwardly from the medial portion of opposite sides of the selector slides 36, 37 and are slidable in guide grooves 49 formed between side plates 48 and the guide grooves 35. Compression springs 50 are disposed in the guide grooves 49 and resiliently urge the selector slides 36, 37 to their outermost or inactive positions. Guide blocks 51 are fixed at opposite sides of the side plates 48 and a cover plate 52 is fixed on the upper end of the support bracket 34, as by screws 53 (FIG. 4). The pattern drum 30 is supported for indexable rotation adjacent its upper end on the cover plate 52 and at its lower end in the_support bracket 34. The pattern drum 30 is provided with four pairs of pattern comb receiving grooves 55 with each pair of grooves being comparatively widely spaced apart from each other and positioned in a 90-degree relationship. However, it is to be understood that a larger number of grooves 55 may be provided on the pattern drum, if the space between the grooves is reduced.

Pairs of pattern combs 56, 57 are supported in the pairs of grooves 55 and are provided with outwardly extending butts extending in vertical rows and movable into aligned engagement with the outer ends of the selector slides 36, 37, depending upon the pattern of butts on the pattern combs 56, 57. The pattern combs 56 will be referred to as tuck pattern combs since they are adapted to engage and operate the tuck position selector slides 37 while the pattern combs 57 will be referred to as welt pattern combs since they are aligned with and adapted to engage and operate the welt position selector slides 36.

Figure 3:
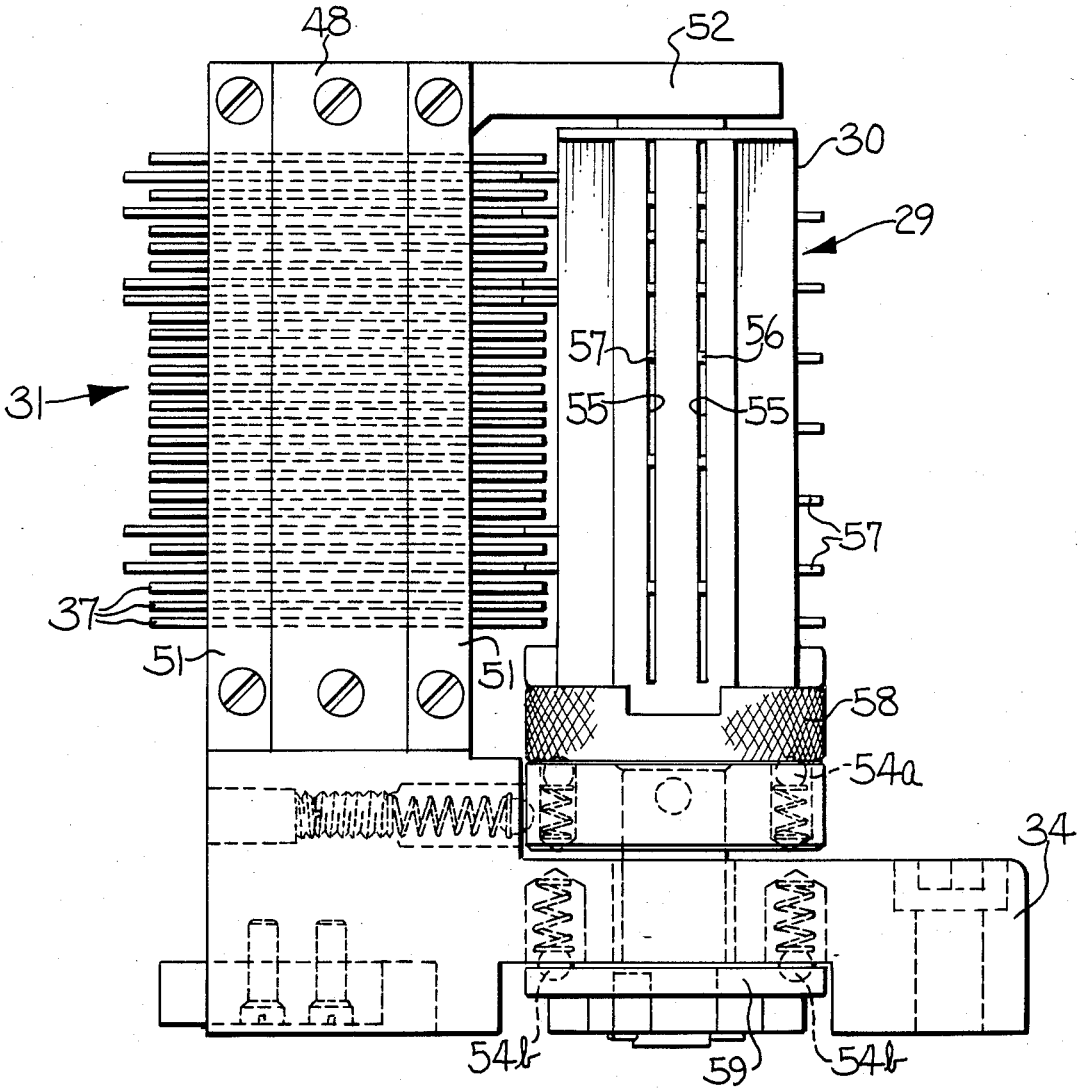
FIG. 3 is a side elevational view of the needle selection device shown in FIG. 2.

A pattern comb set ring 58 extends around the lower portion of the pattern drum 30 and operates to prevent the pattern combs 56, 57 from being displaced out of the grooves 55 when they are placed therein. Rotation of the pattern comb set ring 58 is resisted by means of spring pressed balls **54*a* (FIG. 3). A pattern drum set ring 59 is fixed to the lower end portion of the pattern drum 30 and is adapted to be engaged by spring pressed balls 54*b* (FIG. 3) supported in the support bracket 34 when the pattern drum is rotated one-quarter of a revolution. Stepped rotation is imparted to the pattern drum 30 in a conventional manner to successively present rows of the pattern combs 56, 57 in engagement with the outer ends of the selector slides 36, 37**.

When the pattern butts on the pairs of adjacent tuck and welt pattern combs 56, 57 are broken off in alignment with the corresponding tuck and welt selector slides 37, 36, the selector slides are not urged inwardly and remain in an outermost or inactive position, as shown in FIG. 4, so that the pattern jacks 23 remain in an outwardly rocked position. In this instance, the raising butt 18 of the spring jack 14 remains in an outermost position and is raised by the raising cam 20 to its highest position with further rotation of the needle cylinder, as shown in FIG. 7-A. The spring jack 14 is then lowered by the lowering butt 19 and the lowering cam 21 while the needle 4 continues to move upwardly until it reaches its highest knit position whereupon a yarn is fed into the hook for knitting. Then, the operating butt 5 of the needle 4 is lowered by the stitch cam 8 to form a stitch loop thereon.

When a pattern butt is provided on the welt pattern comb 57 and no butt is provided on the tuck pattern comb 56, as shown in FIG. 5, the corresponding welt position selector slide 36 is moved inwardly to the active position and the tuck position selector slide 37 is also moved inwardly by engagement of the projection 44*a* with the cutout 44*b* so that both selector slides 36, 37 are simultaneously moved inwardly to the innermost active position. In this case, the pattern jack 23 is forced inwardly to an inward position against the spring force of the spring jack 14 so that the raising butt 18 is moved inwardly and out of the path of travel of the raising cam 20, thus passing in front of this raising cam 20. Therefore, the spring jack 14 and the needle 4 are not raised but remain in the unelevated welt position, as shown in FIG. 9-A, so that the upper hooked end of the needle 4 passes the yarn feed finger in a lowered position to welt or float. The inwardly moved tuck position selector slide 37 remains in the innermost position to prevent the selector jacks 23 from again being rocked outwardly until after they have passed the vertical position of the tucking cam.

When the welt pattern comb 57 is devoid of a butt and the tuck pattern comb 56 is provided with a butt, as shown in FIG. 6, only the tuck position selector slide 37 is moved inwardly to an active position for engagement with a corresponding pattern butt 24 of the pattern jack 23 so that the pattern jack 23 is moved inwardly thereby. As illustrated in FIG. 8-A, the pattern jack 23 is forced inwardly against the spring force of the spring jack 14 and the vertical extension 22 is also forced inwardly so that the raising butt 18 of the spring jack is moved inwardly out of the path of travel of the raising cam 20. The raising butt 18 is thus forced inwardly away from the travel path of the raising cam 20 after the spring jack has been moved upwardly to a position high enough to raise the corresponding cylinder needle upwardly to tucking level. As the needle passes the yarn feed finger at this tuck level, the yarn is fed into the hook thereof but the prior stitch loop is not shed below the lower tip of the latch so that a tuck loop is formed by the lowering of the needle 4 by the stitch cam 8.

Thus, the needle selection device of the present invention makes it possible to selectively position the knitting needles in three different positions, namely, knit, tuck and welt positions and the pattern combs in the pattern drum of the present invention are much simpler in operation, may be more quickly changed, and are more practical than the prior art type of needle selection device including a pattern drum with pattern pins provided thereon. The provision of side-by-side vertical stacks of selector slides also provides for the selective simultaneous movement of both adjacent selector slides by a single pattern comb when desired.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A needle selection device for a circular knitting machine including needles supported for vertical movement in slots in a needle cylinder, a pattern jack positioned in each slot in the needle cylinder and beneath each needle, said pattern jacks including spaced selector butts thereon and being operable to cause said needles to selectively knit, welt and tuck, a pair of side-by-side stacks of selector slides supported for individual horizontal sliding movement between innermost and outermost radial positions relative to said needle cylinder and including inner ends vertically aligned with said selector butts of said pattern jacks, and a single pattern device supported for engagement with the outer ends of said selector slides, said single pattern device being operable to radially position said side-by-side selector slides to cause selected needles to either knit, welt or tuck, said side-by-side selector slides including engagement portions on their outer ends including a projection at the rear end of one of said selector slides and a cutout at the rear end of the other of said selector slides and adapted to be engaged by said projection so that adjacent pairs of side-by-side selector slides are simultaneously moved inwardly by said pattern butt means engaging and moving inwardly said selector slide including said projection provided thereon.

2. A needle selection device according to claim 1 wherein said single pattern device comprises an indexable pattern drum.

3. A needle selection device according to claim 2 including pairs of vertically aligned rows of pattern butt means supported in spaced-apart relationship on said pattern drum, and wherein said pairs of vertically aligned pattern butt means are movable into aligned engagement with the outer ends of corresponding selector slides of said pair of side-by-side stacks of selector slides.

4. A unitary needle selection device for a circular knitting machine including a circular series of independently movable latch needles supported for vertical movement in the slots of a needle cylinder, a pattern jack positioned in each of the slots in operative relations to the needles therein to cause the needles to be selectively placed in knit, welt and tuck positions, the device including a pair of spaced first and second cams disposed circumferentially about the needle cylinder with each of the cams being individually movable radially of the needle cylinder between inward and outward positions, the arrangement being such that with both of the cams in radially outward position the jacks are in position to cause the needles to be in knit position, that with the first cam in radially inward position the jacks are in position to cause the needles to be in welt position, and that with the first cam in radially outward position and with the second cam in radially inward position the jacks are in position to cause the needles to be in tuck position, pattern drum means individual to the unitary selection device to position the cams as set forth, said first and second cams including engagement portions on their outer ends including a projection at the rear end of said first cam and a cutout at the rear end of said second cam and adapted to be engaged by said projection so that said first and second cams are simultaneously moved inwardly by said pattern drum means engaging and moving inwardly said first cam including said projection provided thereon.

5. A unitary needle selection device according to claim 4 wherein said pattern drum is indexable, and including pairs of vertically aligned rows of pattern butt means supported in spaced-apart relationship on said pattern drum, and wherein said pairs of vertically aligned pattern butt means are movable into aligned engagement with the outer ends of corresponding selector slides of said pair of side-by-side stacks of selector slides.

6. A needle selection device for a circular knitting machine including needles supported for vertical movement in slots in a needle cylinder, a pattern jack positioned in each slot in the needle cylinder and beneath each needle, said pattern jacks including spaced selector butts thereon and being operable to cause said needles to selectively knit, welt and tuck, a pair of side-by-side stacks of selector slides supported for individual horizontal radial sliding movement between innermost and outermost positions relative to said needle cylinder and including inner ends vertically aligned with said selector butts of said pattern jacks, and pattern means supported for engagement with the outer ends of said selector slides, said pattern means being operable to selectively permit a pair of said side-by-side selector slides to remain in an outermost position to cause selected needles to knit, to permit one of said pair of side-by-side selector slides to be moved to an innermost position while the other of said pair of side-by-side selector slides remains in an outermost position to cause selected needles to tuck, and to permit said pair of side-by-side selector slides to be moved to an innermost position to cause selected needles to welt, said side-by-side selector slides including engagement portions on their outer ends including a projection at the rear end of one of said selector slides and a cutout at the rear end of the other of said selector slides and adapted to be engaged by said projection so that adjacent pairs of side-by-side selector slides are simultaneously moved inwardly by said pattern butt means engaging and moving inwardly said selector slide including said projection provided thereon.

7. A needle selection device according to claim 6 wherein said pattern means includes a pattern drum supported for indexable rotation adjacent the outer ends of said selector slides, and pairs of vertically aligned rows of pattern butt means supported in spaced-apart relationship on said pattern drum, one vertical row of each of said pairs of vertically aligned pattern butt means being movable into aligned engagement with the outer ends of one stack of said selector slides, the other vertical row of each of said pairs of vertically aligned pattern butt means being movable into aligned engagement with the outer ends of the other stack of said selector slides.

8. A needle selection device for a circular knitting machine including needles supported for vertical movement in slots in a needle cylinder, a pattern jack positioned in each slot in the needle cylinder and beneath each needle, said pattern jacks including spaced selector butts thereon and being operable to cause said needles to selectively knit, welt and tuck, a pair of side-by-side stacks of selector slides supported for individual horizontal sliding movement between innermost and outermost positions relative to said needle cylinder and including inner ends vertically aligned with said selector butts of said pattern jacks, a pattern drum supported for indexable rotation adjacent the outer ends of said selector slides, pairs of vertically aligned rows of pattern butt means supported in spaced-apart relationship on said pattern drum, one vertical row of each of said pairs of vertically aligned pattern butt means being movable into aligned engagement with the outer ends of one stack of said selector slides, the other vertical row of each of said pairs of vertically aligned pattern butt means being movable into aligned engagement with the outer ends of the other stack of said selector slides so that said pattern butt means can be arranged to selectively permit a pair of said side-by-side selector slides to remain in an outermost position to cause selected needles to knit, to permit one of said pair of side-by-side selector slides to be moved to an innermost position while the other of said pair of side-by-side selector slides remains in an outer most position to cause selected needles to tuck, and to permit said pair of side-by-side selector slides to be moved to an innermost position to cause selected needles to welt, said side-by-side selector slides including engagement portions on their outer ends including a projection at the rear end of one of said selector slides and a cutout at the rear end of the other of said selector slides and adapted to be engaged by said projection so that adjacent pairs of side-by-side selector slides are simultaneously moved inwardly by said pattern butt means engaging and moving inwardly said selector slide including said projection provided thereon.

9. A needle selection device according to claim 8 wherein said pairs of vertically aligned pattern butt means are positioned in a 90-degree relationship on said pattern drum.

10. A needle selection device according to claim 9 wherein said pairs of vertically aligned pattern butt means comprise vertically disposed pattern combs.

* * * * *